US006651902B2

(12) United States Patent
Ehinger et al.

(10) Patent No.: US 6,651,902 B2
(45) Date of Patent: Nov. 25, 2003

(54) DEVICE FOR SPRAYING A COATING PRODUCT

(75) Inventors: Pierre Ehinger, Faverges (FR); Caryl Thome, Saint Egreve (FR)

(73) Assignee: Sames Technologies, Meylan (FR)

( * ) Notice: Subject to any disclaimer, the term of this patent is extended or adjusted under 35 U.S.C. 154(b) by 0 days.

(21) Appl. No.: 10/169,933

(22) PCT Filed: Jan. 10, 2001

(86) PCT No.: PCT/FR01/00072

§ 371 (c)(1),
(2), (4) Date: Jul. 11, 2002

(87) PCT Pub. No.: WO01/51216

PCT Pub. Date: Jul. 19, 2001

(65) Prior Publication Data

US 2003/0015607 A1 Jan. 23, 2003

(30) Foreign Application Priority Data

Jan. 14, 2000 (FR) ..... 00 00489

(51) Int. Cl.[7] ..... B05B 1/28; A62C 31/00; A62C 31/02

(52) U.S. Cl. ..... 239/104; 239/112; 239/305; 239/392

(58) Field of Search ..... 239/104, 112, 239/305, 392, 303, 304, 583, 390, 391, 397, 408, 413; 251/149.6; 137/614.04; 222/148, 144.5, 145.5, 143

(56) References Cited

U.S. PATENT DOCUMENTS 2,257,004 A * 9/1941 Fleming ..... 239/112
3,135,467 A * 6/1964 Greenman ..... 239/304
3,240,225 A 3/1966 Barrows
3,443,578 A 5/1969 Hedin
3,674,207 A * 7/1972 Carbonetti et al. ..... 239/69
3,782,632 A * 1/1974 Braun et al. ..... 239/112
3,924,810 A 12/1975 Otterstetter
4,163,523 A * 8/1979 Vincent ..... 239/305
4,785,760 A 11/1988 Tholome
5,211,197 A * 5/1993 Marrison et al. ..... 137/614.04
5,215,122 A * 6/1993 Rogers et al. ..... 137/614.04
5,221,047 A * 6/1993 Akeel ..... 239/123
5,406,980 A * 4/1995 Allread et al. ..... 137/614.03

FOREIGN PATENT DOCUMENTS

EP 0 274 322 7/1988

* cited by examiner

*Primary Examiner*—Gene Manoene
*Assistant Examiner*—Darren Gorman
(74) *Attorney, Agent, or Firm*—Browdy and Neimark, P.L.L.C.

(57) ABSTRACT

At least one spraying device (1) and several supply lines (8) for supplying the spraying device with a coating product, the lines being linked to a connecting assembly (3). Each downstream end (6) of a line is provided with a gate valve which can be controlled by an actuator (30) which is itself controlled and which is positioned at the entrance to a product supply pipe (2) for the spray device (1). The actuator (30) and the connecting assembly (3) can be displaced in relation to each other ($F_1$–$F_4$) in such a way that the actuator (30) can be positioned selectively facing a downstream end (6) of one of the supply lines (8) and can manoeuvre the valve of the line. The ends (6) of the lines are arranged in rows and columns and an assembly (30) composed of the actuator and connected to the supply pipe (2) is mobile parallel to a plane surface (5*a*) where these line ends (6) open out.

11 Claims, 5 Drawing Sheets

DEVICE FOR SPRAYING A COATING PRODUCT

The invention relates to a device for spraying coating product and, more specifically, to a device comprising at least one spraying device capable of selectively spraying different products on objects to be coated.

It is known to use a device called a unit for changing coating product or "colour changing unit" to supply one or more devices for spraying coating product from different lines each connected to a tank of coating product.

An installation is known from EP-A-0 274 322, in which a multi-axis robot bears a tank of coating product connected to a spraying device and allowing it to be supplied with product from connection means provided at a fixed station in a booth. Furthermore, WO-A99/52644 discloses a process and an installation for spraying coating product, in which a station for cleaning-filling a tank, borne by a multi-axis robot and associated with a spraying device, is disposed in a booth, this station comprising a product changing unit connected to supply circuits and a carrousel of tanks for the least used shades.

DE-A-42 14 779 discloses a manual device for changing colours in which an alignment between a downstream pipe and a plurality of upstream pipes is obtained by rotation of a deck. Controlled valves must be provided both upstream and downstream of this device, these valves having to be manoeuvred by hand or being constituted by electro-valves whose cost price is high.

The known systems therefore generally comprise a large number of controlled valves or electro-valves and numerous pipes and pneumatic connections for theses valves, which increases their cost price and renders the cleaning operations more complex insofar as these valves must be cleaned with considerable care in order to avoid a mixture of the coating products detrimental to a spraying of quality as required, in particular, in the domain of automobile vehicle construction.

U.S. Pat. No 3,240,225 discloses an apparatus for selecting paint in which paint pipe inlets are arranged in a circle, which imposes movements of considerable amplitude on the connection device which is associated therewith. This results in the compulsory use of relatively long supple pipes which must be drained and cleaned each time the product is changed, hence a relatively great consumption of paint and solvent. In addition, the circular movements imposed on the mobile members are long, hence a relatively long minimum cycle time for a paint changing operation.

It is a more particular object of the invention to overcome these drawbacks by proposing an installation comprising a reliable and economical coating product changing system while remaining easy to clean.

In that spirit, the invention relates to a device for spraying coating product comprising at least one spraying device and a plurality of lines for supplying this spraying device with coating product linked to a connecting assembly, in which each downstream end of a supply line is provided with a gate valve which can be controlled by a controlled actuator positioned at the entrance to a supply pipe for the spraying device, this actuator and this assembly being adapted to be displaced in relation to each other in such a way that the actuator can be selectively positioned opposite a downstream end of one of the supply lines and can manoeuvre the valve of that line. This device is characterized in that the ends of the lines are arranged in rows and in columns while an assembly comprising the actuator and connected to the supply pipe is mobile parallel to a plane surface of this plate where the line ends open out.

Thanks to the invention, one sole actuator is used for the selective connection of a plurality of supply lines with the spraying device and/or a tank associated therewith. It is therefore not necessary to provide a large number of actuators, such as electro-valves, as is the case in the prior art systems. The valves housed in the downstream ends of the supply lines are controlled by the actuator only when the latter is correctly positioned with respect to the corresponding end, with the result that there is no risk of accidental opening when the connecting assembly and the supply pipe are not correctly positoned in relation to each other. The risks of leakage of coating product are therefore minimized and the installation is "anti-drip" by nature. Moreover, the device of the invention is substantially more compact than those of the state of the art while the angular position of the supply lines, on the one hand, and of the supply pipe, on the other hand, are compatible with a high-speed flow of the coating product. The ends of the supply lines and the supply pipe are easy to clean, which allows a saving of coating product during product changes. Finally, due to the arrangement of the line ends in rows and columns, it is possible to displace the assembly comprising the actuator freely in two directions perpendicular to each other and parallel to the plane surface. This facilitates selection of the coating product to be sprayed.

According to advantageous but non-obligatory aspects of the invention, the device incorporates one or more of the following characteristics:

- the valve of each supply line end comprises a means for elastically returning into closed position, the actuator being adapted to open this valve against these return means.
- the actuator is adapted to be partially engaged in each supply line end and comprises a part forming pusher adapted to displace a flap of the corresponding valve towards a position of opening of this valve.
- the connecting assembly comprises means for supplying air and/or product for cleaning the pipe and/or the actuator, these means being continuously connected on the mobile assembly, by means of supple tubes.

According to a first advantageous embodiment of the invention, the actuator comprises a tubular sleeve adapted to penetrate in the gate valve of the supply line end and inside which is disposed a flap for closure of the pipe, this sleeve being adapted to immobilize the mobile assembly with respect to the plate by cooperation of shapes. In this way, the downstream end of the supply line and the pipe are obturated as soon as the actuator is spaced apart from the connecting assembly.

According to another embodiment of the invention, the actuator comprises a pneumatically controlled pusher mobile in translation in a chamber formed in a body fast with the spraying device and comprising a tank for storing coating product. This corresponds to the case of a tank borne at the end of the arm of a robot as described in EP-A-0 274 322 and WOA-99/52644. The body advantageously comprises means for connecting the chamber to a source of air and/or of cleaning product.

The invention will be more readily understood and other advantages thereof will appear more clearly in the light of the following description of two forms of embodiment of a spraying device in accordance with its principle, given solely by way of example and made with reference to the accompanying drawings, in which:

FIG. 1 schematically shows a device in accordance with a first form of embodiment of the invention.

Figure 5:
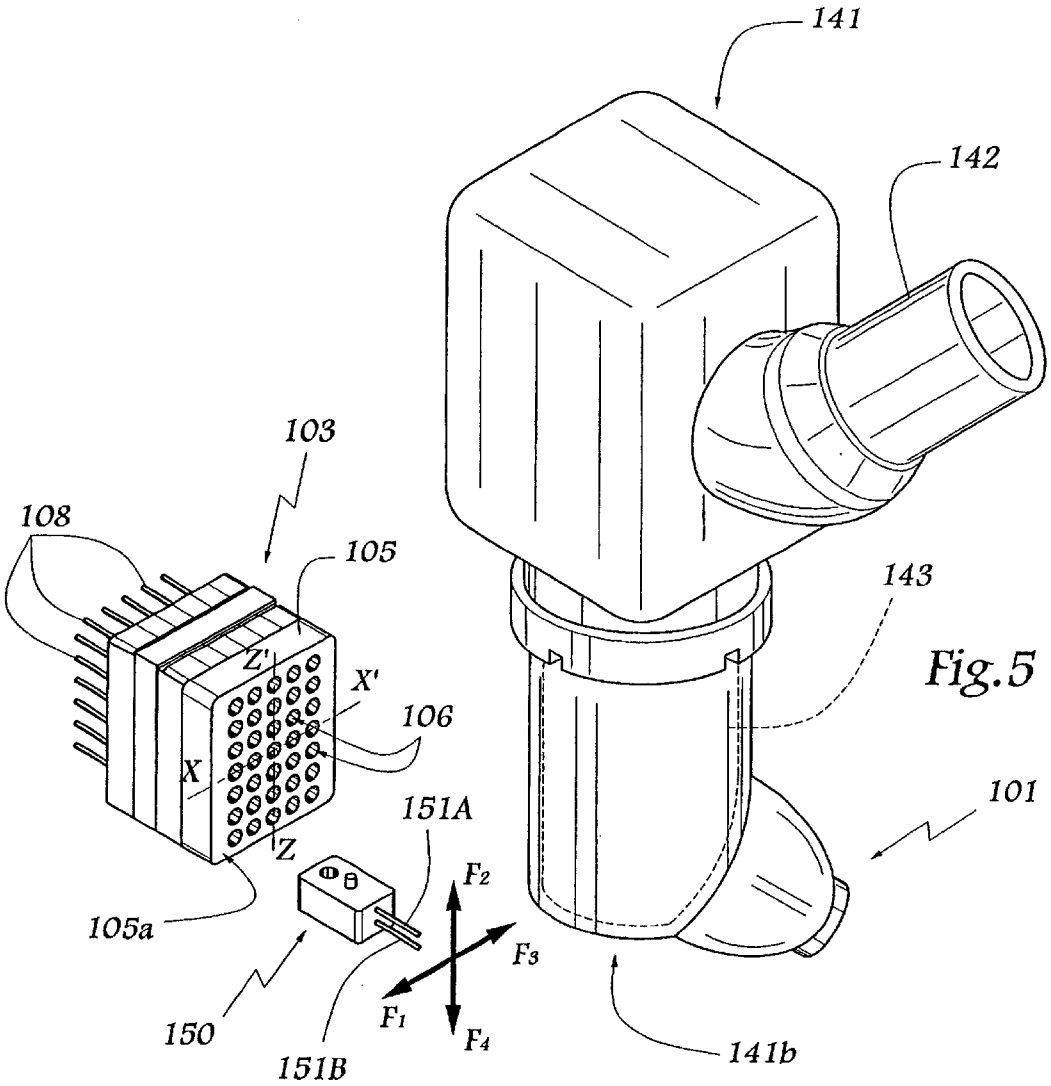

FIG. 5 schematically shows a device in accordance with a second form of embodiment of the invention.

Figure 1:
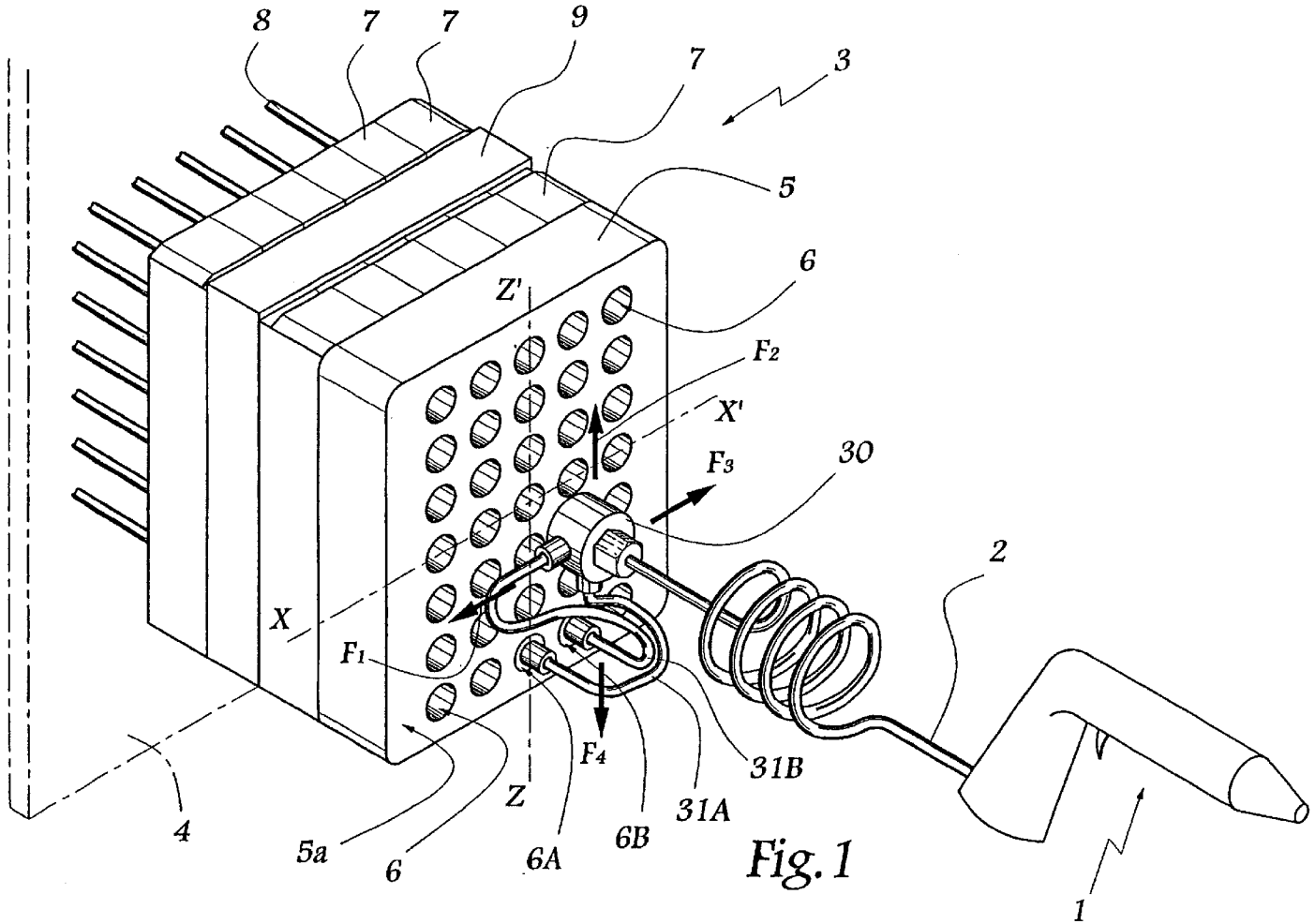
Figure 6:
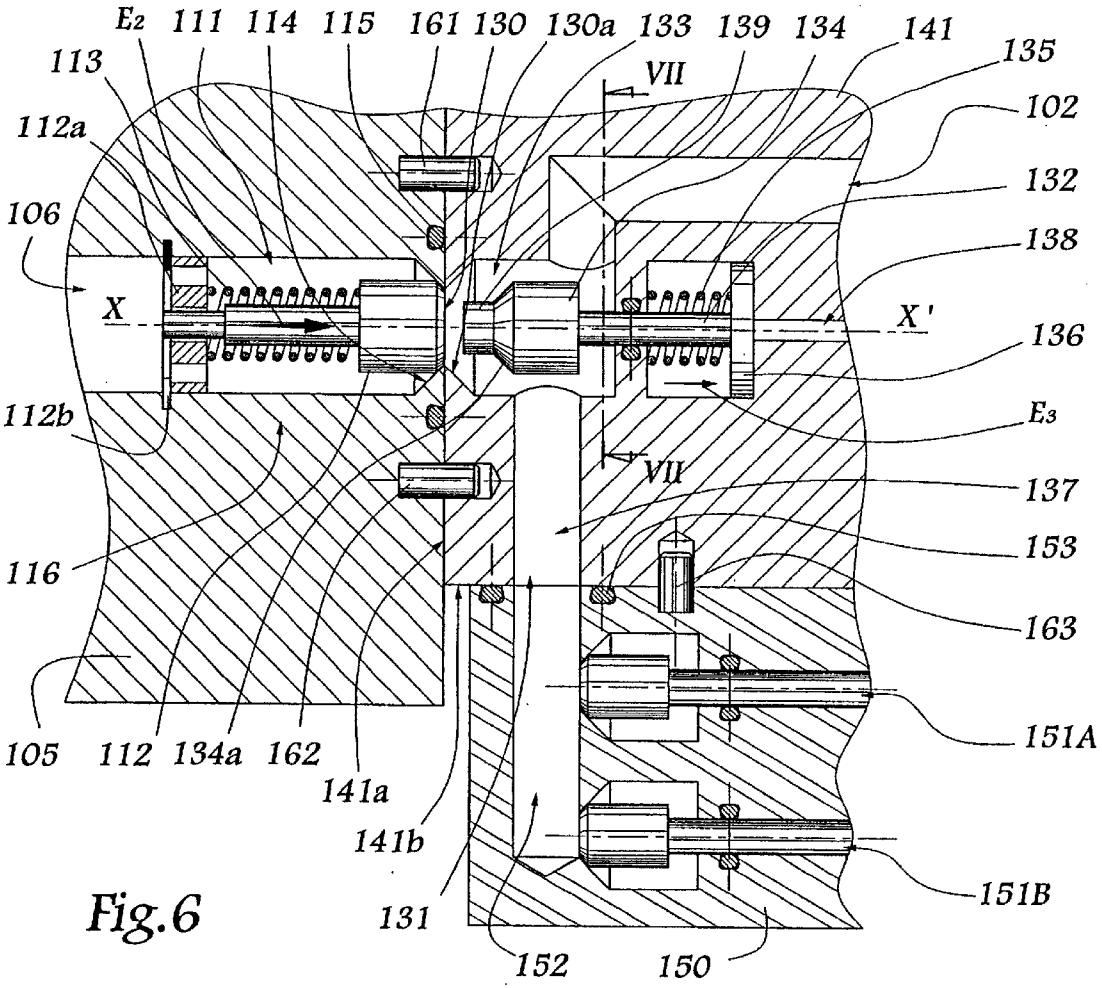

FIG. 6 is a partial section of the device of FIG. 1 in a first configuration.

Figure 7:
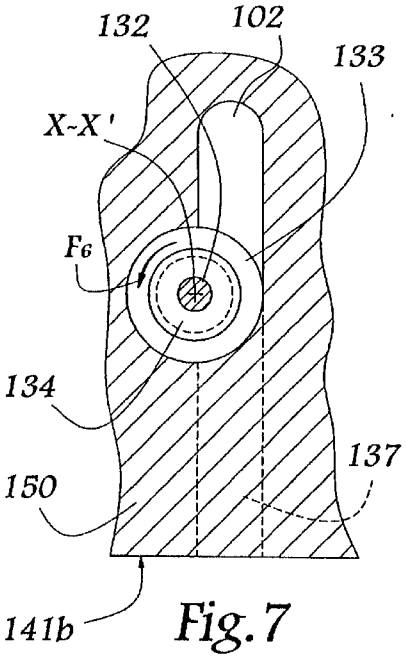

FIG. 7 is a partial section along line VII—VII in FIG. 6, and

Figure 8:
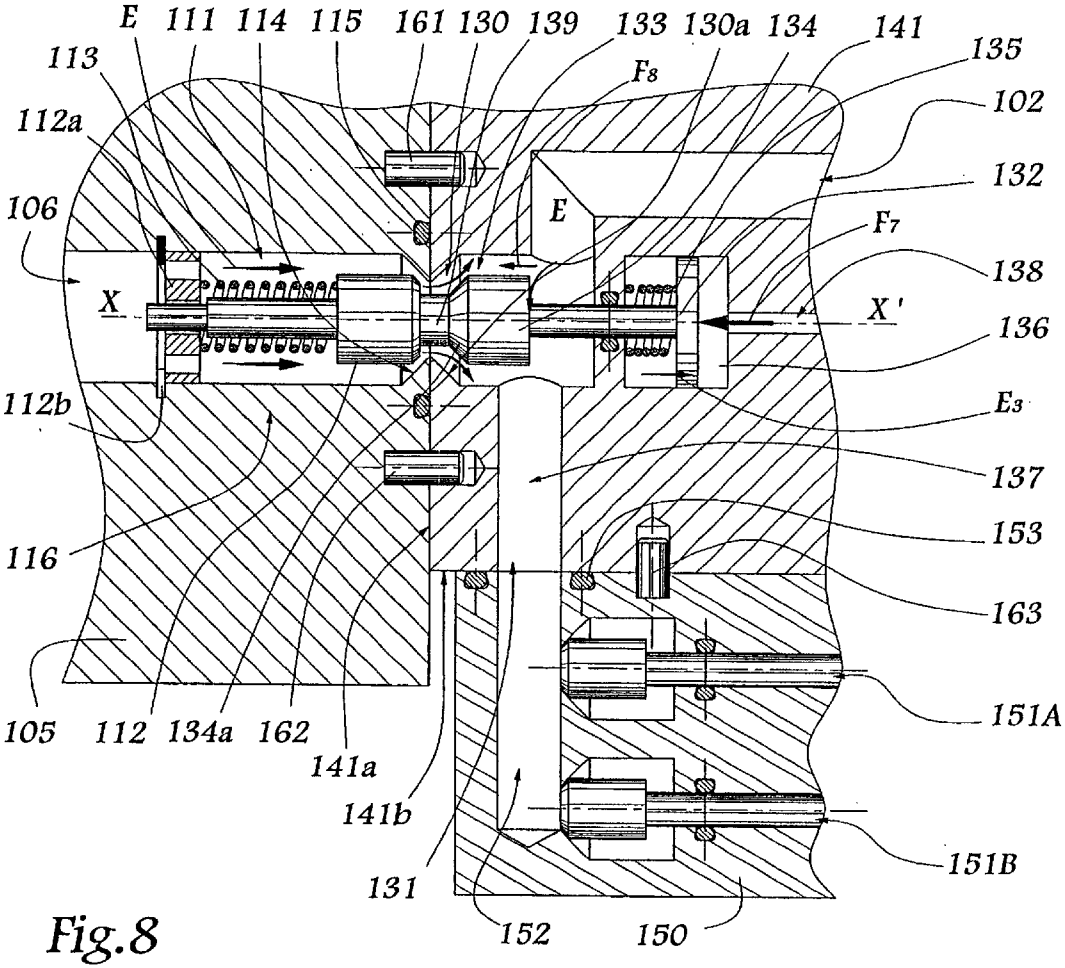

FIG. 8 is a view similar to FIG. 6, while the device is in a second configuration of operation.

The device shown in FIGS. 1 to 4 comprises a manual device for spraying coating product intended to be used by an operator inside a booth. This spraying device is supplied with coating product, air and cleaning product through a supple pipe 2 connected on an assembly 3 provided to be installed at the level of a partition 4 of the coating booth.

The assembly 3 comprises a base plate 5 pierced with thirty orifices 6 arranged in rows and columns while juxtaposed spacer members 7 define therebetween zones for receiving and immobilizing the downstream ends 10 of pipes 8 each connected to a source of coating product. The spacer members 7 are maintained in position with respect to one another by a strap retainer 9. The number of spacer members 7 and the number of orifices in the plate 5 is adapted as a function of the number of coating products provided to be used in the device.

Figure 2:
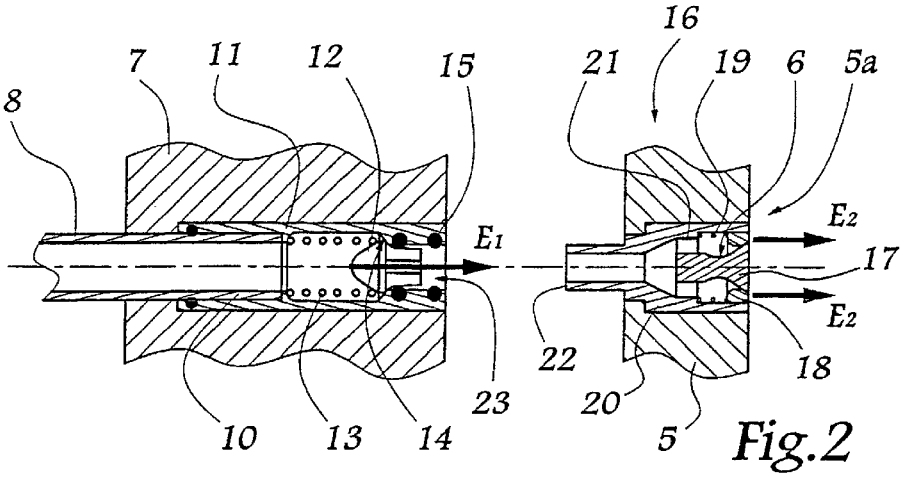
FIG. 2 is a partial transverse section of a connecting assembly of the device of FIG. 1, before assembly.

As is more clearly visible in FIG. 2, the downstream end 10 of a pipe 8 is received in a sleeve 11 provided with a flap valve 12 elastically loaded by a spring 1 3 in the direction of a seat 14. Two O-rings 15 are arranged downstream of the flap valve 12. In this way, the sleeve 11 constitutes an end stopper of the pipe 8, this stopper being able to be opened by displacement of the flap valve 12 against an elastic effort $E_1$ exerted by the spring 13 and by the pressure of the product inside the pipe 8.

The tight nature of the device formed the elements 11 to 15 makes it possible to position the different ends 10 of different pipes 8 between two spacer members 7 without risk of leakage. During assembly of the installation, the different ends 10 of the pipes 8 are immobilized between spacer members 7 and the strap 9 is used for maintaining the pipes 8 and the spacer members 7 in position.

Each orifice 6 in the plate 5 is equipped with a valve 16 provided with a fixed central element 17 and with an annular flap 18 adapted to come into abutment, against the element 17 forming seat, under the effect of an elastic effort $E_2$ exerted by a spring 19. The body 20 of the valve 16, which is connected to the element 17 by clips 21, extends by a tubular part 22 intended to be engaged in an outlet bore 23 of the sleeve 1.

Figure 3:
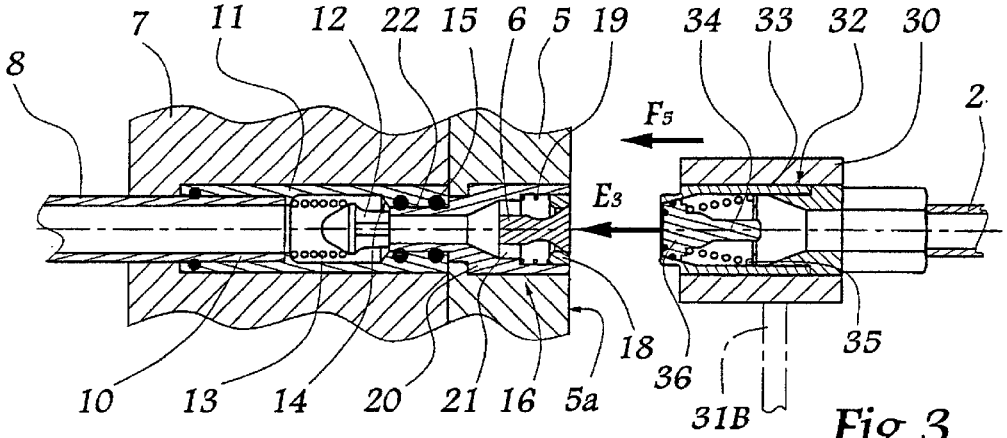
FIG. 3 is a partial transverse section of the device of FIG. 1 during a first stage of use.

In this way, when the different spacer members 7 have been assembled, the plate 5 is positioned with respect to the assembly thus produced by introducing the tubular parts 22 of the different valves 16 in the bores 23 of the different sleeves 11, the O-rings 15 guaranteeing tightness between the elements 22 and 23. This has the effect of pushing the flaps 12 against the effort exerted by the springs 13 as represented in FIG. 3. Each body 20 of valve 16 thus constitutes the downstream end of a supply line formed by a pipe 8, a sleeve 11 and a valve 16.

A selection member 30 is formed by a connection capable of being selectively mounted on one of the orifices 6, except for two particular orifices 6A and 6B which are respectively connected to a source of pressurized air and to a source of product for cleaning the spraying device 1. The selection member 30 is connected to the orifices 6A and 6B by two supple tubes 31A and 31B, tubes 31A and 31B being connected to the pipe 2 inside the member 30. The member 30 includes a valve 32 comprising a substantially cylindrical body 33 and a flap 36 loaded by a spring 35 generating elastic effort $E_3$ in the direction of an inner truncated part of the body 34, the flap itself being truncated.

As represented by arrows $F_1$ to $F_4$, the member 30 may be displaced parallel to the planar end surface 5*a* of the plate so as to take the valve 32 selectively opposite one of the valves 16. When a user wishes to use a coating product, it suffices for him to select, automatically or manually, the corresponding orifice 6, which may be identified by a label (not shown), and to dispose the member 30 opposite this orifice by a movement in a vertical direction Z–Z', in the direction of arrow $F_2$ or arrow $F_4$, or in a horizontal direction X–X', in the direction of one of arrows $F_1$ and $F_3$. The directions X–X' and Z–Z' are parallel to the front surface 5*a* of the plate 5.

Due to the arrangement of the orifices 6 in rows and columns, it is easy to reach each of them by a movement in the direction X–X' and/or in the direction Z–Z', without having to resort to a circular movement of great amplitude. It is noted that only the member 30 is displaced, the plate 5 remaining immobile.

It is then possible to displace the member 30 in the direction of this orifice as represented by arrow $F_5$ in FIG. 3, with the result that a front tubular part 34 of the body 33 of the valve 32 penetrates inside the valve 16 and thus pushes the flap 18 against the effort $E_2$ exerted by the spring 19. The central element 17 also pushes the flap 36 against the effort $E_3$ due to the spring 35.

Figure 4:
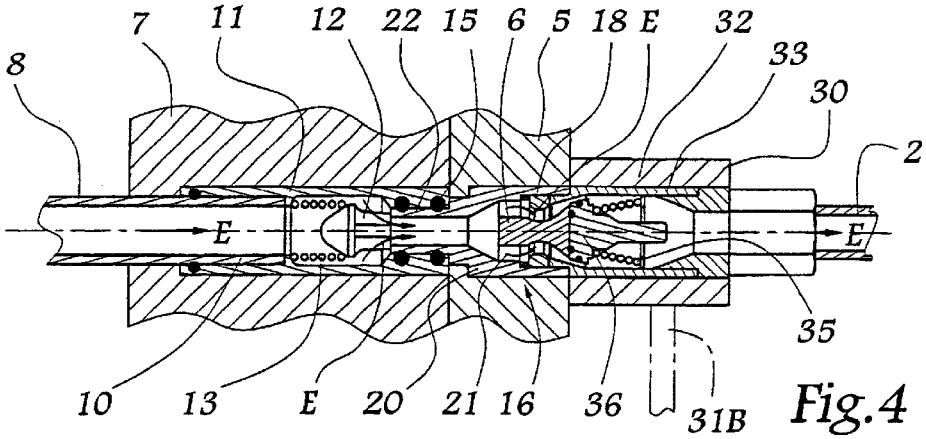
FIG. 4 is a view similar to FIG. 3 during a second stage of use.

This has the effect of placing the internal volume of valve 16 and the internal volume of valve 32 in communication, a flow in that case occurring between the end 10 of the pipe 8 and the pipe 2 as represented by arrows E in FIG. 4.

Therefore the part 34 makes it possible both to immobilize the member 30 with respect to the plate 5 by cooperation of shapes and to manoeuvre the flap 18 of the end valve 16 of the supply line to which the pipe 8 belongs.

When the coating product is to be changed, the operator has only to displace the member 30 to another orifice 6, the valve 32 being able to be cleaned at any moment as the member 30 remains permanently connected to the orifices 6A and 6B. The supple nature of the tubes 31A and 31B allows a continuous connection of the member 30 to the orifices 6A and 6B independently of the movements of the member 30 in the direction of arrows $F_1$ to $F_4$.

In the second embodiment of the invention shown in FIGS. 5 to 8, elements similar to those of the first embodiment bear identical references increased by 100. A spraying device 101 is mounted inside a spraying assembly 141 arranged at the end of the arm 142 of a multi-axis robot and comprising a tank 143 for temporarily storing coating product.

At the end of a coating operation, or when the tank 143 is empty or almost empty, the assembly 141 is moved towards a connecting assembly 103 comprising an interface plate 105 of which the substantially plane front surface 105*a* is provided with different orifices 106 connected to pipes 108 for supplying coating product.

A unit 150 is connected to a source of pressurized air and to a source of cleaning product by two supple pipes 151A and 151B. The unit 150 is mobile in translation, parallel to the front surface 105*a* and in two directions X–X' and Z–Z', as represented by arrows $F_1$ to $F_4$.

When the tank 143 is to be filled with coating product, a unit for controlling the device determines which of the orifices 106 must be connected to this tank. Further to this determination, the unit 150 is displaced by any appropriate means, for example by a carriage controlled thanks to jacks, to be arranged immediately below the orifice 106 selected.

According to a variant of the invention (not shown), the assembly 141 may be brought into the same position for each cleaning-filling operation. The unit 150 is in that case mobile essentially in a direction perpendicular to the surface 141*b* between two positions respectively in abutment against this surface and at a distance from the assembly 141. The assembly 103 is in that case mounted on a carriage mobile along three orthogonal axes, with the result that it may bring, as a function of needs, one of the orifices 106 opposite the actuator 132. In other words, the relative position of the actuator and of the orifices is adjusted by displacement of the assembly 103, while the assembly 141 conserves the same position for each cleaning-filling operation.

The assembly 141 is then displaced by the arm 142, likewise in the direction of arrows $F_1$ to $F_4$, to arrive in the position of FIG. 6 where an orifice 130 for inlet of the coating product in the assembly 141 is disposed opposite the orifice 106 in question, while a second orifice 131, made on a face 141*b* of the assembly 141 substantially perpendicular to the surface 141*a* in which the orifice 130 is made, is made opposite an outlet orifice 152 of the unit 150.

Each orifice 106 is equipped with a valve 112 undergoing an elastic effort $E_2$ generated by a spring 113 in the direction of a seat 114 formed by a truncated part integral with the plate 105. An O-ring 115 is arranged around each orifice 106 and is intended to ensure tightness of the contact between the surfaces 105*a* and 141*a* around the orifices 106 and 130.

The valve 112 is guided in translation, in an inner pipe 111 of the plate 105 opening out at the level of the orifice 106, thanks to a washer 112*a* itself immobilized with respect to the pipe 111 by a circlip 112*b* and against which the spring 113 abuts. The elements 111 to 114 thus constitute an end valve 116 of a line supplying coating product, comprising a pipe 108 and which is obturated by default under the effect of the effort $E_2$.

Downstream of the orifice 130, a chamber 133 is formed inside which is mobile a pusher 134 forming an end of an actuator 132 of which the other end comprises a piston 136 undergoing an elastic effort $E_3$ generated by a spring 135 and directed so that it tends to move the pusher 134 away from the orifice 130.

A pipe 137 connects the orifice 131 and the chamber 133, with the result that air and/or a cleaning product coming from unit 150 can be directed towards the chamber 133.

Opposite the pipe 137, the housing 133 is connected to a pipe 102 for supplying the tank 143 and, through it, the spraying device 101.

X–X' denotes the axis of symmetry of the orifice 106 and of the elements 111 and 115. This axis X–X' is also that of the orifice 130 and of elements 132 to 136 in the positions of FIGS. 6 to 8. As is more particularly visible in FIG. 7, the pipe 137 and the pipe 102 are offset with respect to axis X–X' so that a flow of pressurized air and/or of streams of air and cleaning product, flows in eddies around the actuator 132 in chamber 133, as represented by arrow $F_6$ in FIG. 7. This ensures an efficient cleaning of the actuator 132, particularly in the case of coating product being changed.

When the element 141 has been moved towards the plate 105 and unit 150, pressurized air is directed towards the piston 136 through a pipe 138, as represented by arrow $F_7$ in FIG. 8, which has the effect of displacing the actuator 132 as represented by arrow $F_8$, a front part or nose 139 of the valve 134 in that case penetrating inside the orifice 106 and pushing the valve 112 against the return effort $E_2$ exerted by the spring 113. This has the effect of moving the flap 112 away from the seat 114 and thus allowing a flow of the coating product from the pipe 108 towards the pipe 102, as represented by arrows E.

When the tank 143 is filled, the air pressure on the piston 136 is released and the actuator 132 is returned into the position of FIG. 6 under the effect of the effort $E_3$ due to the spring 135.

Furthermore, a step of cleaning may be provided, in which the assembly 141 is at a distance from the plate 105. In that case, the air pressure on the piston 136 is taken to a value such that the actuator is displaced against the effort $E_3$ to the point that the truncated part 134*a* of the pusher 134 comes into sealed abutment against a likewise truncated seat 130*a* bordering the orifice 130. This makes it possible to isolate the chamber 133 from the end during circulation of a cleaning fluid. This also makes it possible to isolate the chamber 133 from pollutions coming from the ambient atmosphere.

According to a variant of the invention (not shown), a single control may be provided of the displacement of the actuator 132 by the piston 136, a stop being provided on the front surface 105*a* of the plate 105. In that case, as soon as the assembly 141 is moved away from the plate 105, the part 134*a* is applied against the seat 130*a*.

An O-ring 153 is arranged around the orifice 152 and ensures seal between the unit 150 and the surface 141*b* of the assembly 141. Centering lugs 161, 162 and 163 allow a satisfactory relative positioning of the elements 105, 141 and 150.

This embodiment presents the particular advantage that the flap 112 of each of the valves 116 formed in the pipes 111 by the elements 112 to 114 can be manoeuvred by the actuator 132 only if the orifices 130 and 106 are correctly aligned, which avoids any risk of 10 leakage at the level of these orifices.

The plates 5 and 105 may be arranged in horizontal planes, their respective front surfaces 5*a* and 105*a* being oriented downwardly while an optical detector is arranged beneath the assembly 3 or 103. In this way, a possible leakage of product at the level of an orifice 6 or 106 is immediately detected, the adjacent orifices not being soiled by a flow of product along the surface 5*a* or 105*a*.

In the second embodiment, valves for draining excess coating product may be provided.

Whatever the embodiment in question, the coating product circulating in the pipes 8 or 108 is advantageously filtered in order to reduce the risks of leakage at the level of the bearing surfaces of the flaps on the corresponding seats.

What is claimed is:

1. Device for spraying coating product comprising at least one spraying device (1; 101) and a plurality of lines (8; 108) for supplying this spraying device with coating product linked to a connecting assembly (3; 103), device in which each downstream end (6; 106) of a supply line is provided with a gate valve (16; 116) which can be controlled by a controlled actuator (32; 132) positioned at the entrance to a supply pipe (2; 102) for the spraying device, said actuator and said assembly being adapted to be displaced ($F_1$–$F_4$) in relation to each other in such a way that said actuator can be selectively positioned opposite a downstream end of one of said supply lines (8; 108) and can manoeuvre the valve of said line, characterized in that said ends of the lines (6; 106) are arranged in rows and in columns while an assembly (30; 141) comprising said actuator (32; 132) and connected to said supply pipe (2; 102) is mobile parallel to a plane surface (5*a;* 105*a*) where said line ends open out.

2. Device according to claim 1, characterized in that said assembly (30; 141) is adapted to be freely displaced, in two directions (X–X'; Z–Z') parallel to said plane surface (5*a;* 105*a*) and perpendicular to each other, to be disposed Opposite one of said line ends (6; 106).

3. Device according to claim 1, characterized in that said valve (16; 116) comprises means (13; 113) for elastically returning ($E_2$) into closed position, said actuator (32; 132) being adapted to open said valve against said return means.

4. Device according to claim 1, characterized in that said actuator (32; 132) is adapted to be partially engaged in each end (6; 106) of supply line (8; 108) and comprises a part forming pusher (34; 134) adapted to displace a flap (12;112) of said valve (16; 116) towards a position of opening of said valve.

5. Device according to claim 1, characterized in that said connecting assembly (3) comprises means (6A; 6B) for supplying air and/or product for cleaning said pipe (2) and/or said actuator (32), said air and/or cleaning product supply means being continuously connected to said mobile assembly (30), by means of supple tubes (31A, 31B).

6. Device according to claim 1, characterized in that said actuator (32) comprises a tubular sleeve (34) adapted to penetrate in said gate valve (16) and inside which is disposed a flap (36) for closure of said pipe (2), said sleeve being adapted to immobilize said mobile assembly (30) with respect to a plate (5) forming said plane surface (5*a*) by cooperation of shapes.

7. Device according to claim 1, characterized in that the downstream end (10) of a supply line (8) is received in a sleeve (11) forming end stopper of a line adapted to be manoeuvred by a part (22) of a body (20) of valve (16) provided in an orifice (6) of a plate (5) forming said plane surface (5*a*).

8. Device according to claim 1, characterized in that said actuator (132) comprises a pusher (134) pneumatically controlled (136) and mobile in translation in a chamber (133) formed in a body (141) fast with said spraying device (101) and comprising a tank (143) for storing coating product.

9. Device according to claim 8, characterized in that said body (141) comprises means (137) for connecting said chamber (133) to a source (150) of air and/or of cleaning product.

10. Device according to claim 9, characterized in that said connecting means comprise a pipe (137) for circulation of air and/or of coating product, said pipe being offset with respect to an axis (X–X') of symmetry of said actuator (132).

11. Device according to claim 1, wherein said assembly is movable manually parallel to and perpendicular to the plane surface.

* * * * *